US005396748A

United States Patent [19]

Rogers

[11] Patent Number: 5,396,748

[45] Date of Patent: Mar. 14, 1995

[54] JOINT CONSTRUCTION FOR SUSPENDED CEILING SYSTEM

[76] Inventor: David J. Rogers, Building Systems International, P.O. Box 209, Baltimore, Ontario KOK IC0, Canada

[21] Appl. No.: 217,149

[22] Filed: Mar. 24, 1994

[51] Int. Cl.[6] ..... E04B 1/58

[52] U.S. Cl. ..... 52/664; 52/726.2; 52/729; 52/506.07; 52/506.06; 403/346

[58] Field of Search ..... 52/664, 667, 668, 660, 52/506.06, 506.07, 506.08, 726.1, 726.2, 729; 403/346, 263

[56] References Cited

U.S. PATENT DOCUMENTS

| | | | |
|---|---|---|---|
| 1,445,401 | 2/1923 | Lachman | 52/668 |
| 2,873,828 | 2/1959 | Zitomer . | |
| 3,037,594 | 6/1962 | Kaufman | 52/506.06 X |
| 3,159,252 | 12/1964 | Cotts | 52/506.07 X |
| 3,175,655 | 3/1965 | Brown et al. . | |
| 3,340,662 | 9/1967 | Deinhart et al. . | |
| 3,526,073 | 9/1970 | Brady . | |
| 4,580,387 | 4/1986 | Rogers | 52/665 |
| 4,840,005 | 6/1989 | Cochrane . | |

FOREIGN PATENT DOCUMENTS

| | | | |
|---|---|---|---|
| 1234959 | 4/1988 | Canada . | |
| 2644040 | 4/1978 | Germany | 52/664 |

*Primary Examiner*—Carl D. Friedman
*Assistant Examiner*—Robert J. Canfield
*Attorney, Agent, or Firm*—Jones, Tullar & Cooper

[57] ABSTRACT

A new joint construction is provided for connecting main members and cross members of a suspended ceiling grid. Both members are in the form of I-beams having a central web and top and bottom flanges projecting at opposite sides of the web, and the top flanges of the main members have depending lips at their edges. Each joint construction includes a notch in a depending lip capable of receiving the web of a cross member, and opposed slots in the top flange of the end portion of the cross member capable of receiving portions of depending lip on each side of the notch. The lower flange and web of the cross member end portion are configured to allow the lip to be interlocked with the slots by a relative tilting motion between the cross member and the main member, and the cross member rests on the main member lower flange when the parts are in their final position.

4 Claims, 2 Drawing Sheets

JOINT CONSTRUCTION FOR SUSPENDED CEILING SYSTEM

FIELD OF THE INVENTION

The present invention relates to a suspended ceiling system, and especially to a joint construction suitable for a grid formed of non-metallic, beam members which cannot corrode. The grid construction is particularly suitable for food processing areas which are subject to corrosive vapours, and which need a flat lower surface so that they can be easily cleaned.

PRIOR ART

Many joint constructions are known for connecting the main members to cross members in the grid of a suspended ceiling system. Mostly, these joint constructions have been designed for metallic grids, and often involve parts such as tabs which are bent over to secure the joint. Others have, as a part of the joint construction, apertures in the webs of the main members. Examples of such constructions are shown in the following patents:

U.S. Pat. No. 2,873,828, issued Feb. 17, 1959 to Zitomer;

U.S. Pat. No. 3,175,655, issued Mar. 30, 1965 to Brown et al.;

U.S. Pat. No. 3,340,662, issued Sep. 12, 1967 to Deinhart et al.;

U.S. Pat. No. 3,526,073, issued Sep. 1, 1970 to Brady;

U.S. Pat. No. 4,840,005, issued Jun. 20, 1989 to Cochrane;

Canadian Patent No. 762,143, issued Jul. 4, 1967 to National Gypsum Company; and Canadian Patent No. 1,234,959, issued Apr. 12, 1988 to Hunter.

In order to be particularly suitable for food processing areas and other areas having a corrosive environment, the present invention utilizes beam members made of glass fibre reinforced plastics, for both the main and cross members. This material cannot be used for prior art constructions which need bendable tabs, for example those of the U.S. Patents to Brown or Brady. Also, the present invention preferably makes use of pultrusions of the glass fibre reinforced plastics material, and with this material it is undesirable to make apertures in the web, due to stress considerations. The present invention provides a joint construction in which the main members and cross members are easily formed, and in which the members can be easily assembled on site and, when locked together, are secured against both disengagement and sliding relative to each other.

A suspended ceiling system using glass fibre reinforced material is described in my prior U.S. Pat. No. 4,580,387, issued Apr. 8, 1986. Here, the joints are made by clips which grasp the webs of the end portions of cross members forming the joint. The clips are held in place by engagement with small protrusions running along the upper edges of the webs; the members do not have upper flanges. This joint construction avoids any need for bending tabs, and also avoids any apertures in the webs. However, it does require the use of additional clip members.

SUMMARY OF THE INVENTION

The present invention provides a joint construction for a suspended ceiling grid which avoids the need for any separate pieces such as clips. It also avoids the need for holes or apertures in web members, such as would affect the strength of such members especially when these are pultrusions. The joint construction requires only minimal cutting operation to be carried out on the engaging parts. The joint provides a flat underside for the grid so that this can be easily cleaned. The parts are joined by a simple tilting action between the main members and the cross members, and once fitted together the parts are fully locked together.

In accordance with the present invention, in a suspended ceiling system comprising:

a plurality of elongated main members each having a central web and top and bottom flanges projecting at opposite sides of the web, the top flange having a depending lip spaced from each side of the web;

a plurality of elongated cross members each having a central web and top and bottom flanges projecting at opposite sides of the web;

an improved joint construction is provided for connecting an end portion of a cross member to a side of a main member which includes a notch in one of said depending lips capable of receiving said central web of said end portion, and opposed slots in the top flange of the end portion capable of receiving portions of the depending lip on each side of the notch. The lower flange and web of the end portion of the cross member is configured to allow the lip to be interlocked with the slots by a relative tilting motion between the cross member and the main member, the end portion resting on the main member lower flange when the parts are in their final position.

Preferably, the lower flange of the end portion is set back relative to the upper flange of the end portion, the dimensions of the parts being such that with the parts in their final position, a lower surface of the cross member web rests on the lower flange of the main member, and the lower surfaces of the flanges of all members are co-planar.

BRIEF DESCRIPTION OF THE DRAWINGS

The invention will be further described with reference to the accompanying drawings, in which.

DETAILED DESCRIPTION OF THE DRAWINGS

Figure 1:
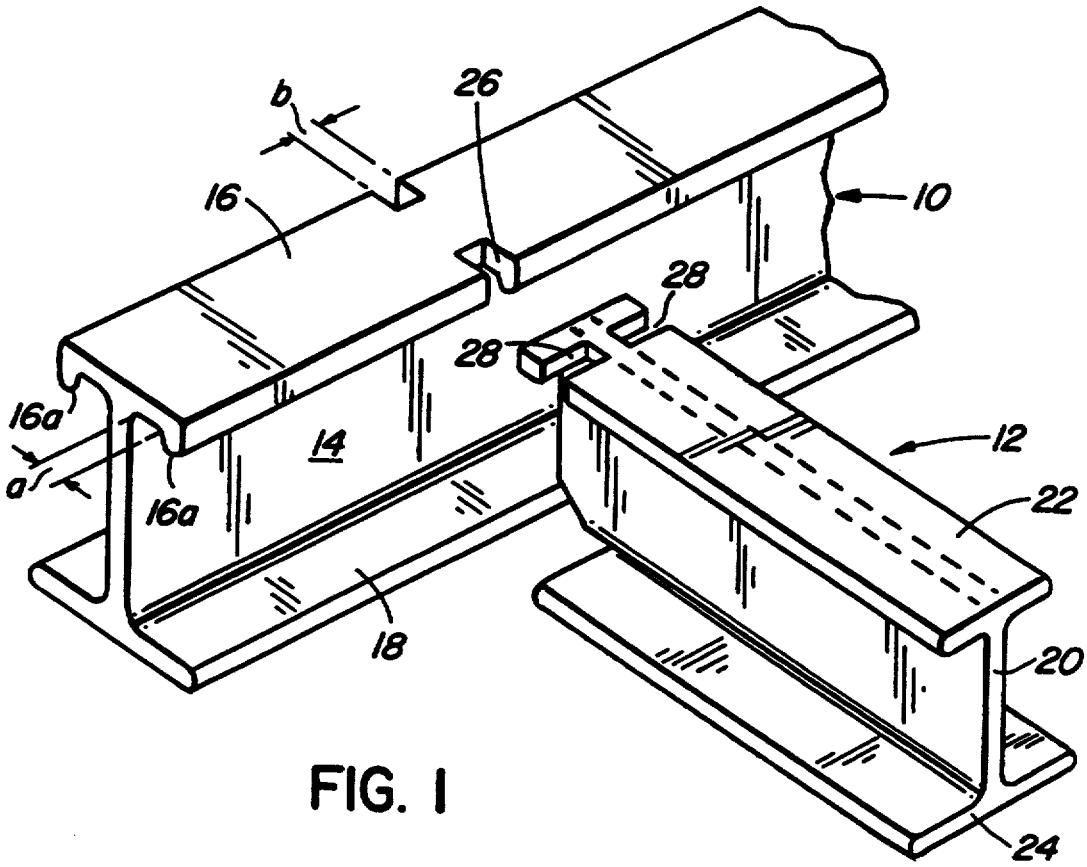
FIG. 1 shows a perspective view of a joint between a main member and a cross member, with the latter in position just prior to assembly of the joint.
Figure 2:
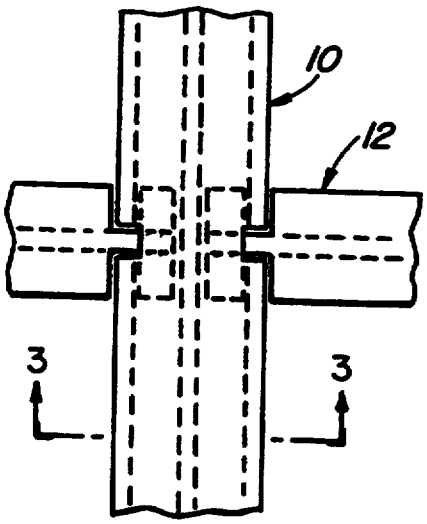
FIG. 2 is a top view of a main member and two cross members when connected together.

Referring to the drawings, both the main member 10 and the cross member 12 are pultrusions of glass fibre reinforced plastic material, and both are in the form of I-beams. The main member 10 has a central web 14, a top flange 16 which projects at opposite sides of the web, and a bottom flange 18 which also projects at opposite sides of the web. The top flange 16 has depending lips **16*a*** along each outer edge, spaced from the side of the web by a distance "a".

The cross member 12 has a central web 20, a top flange 22 and a bottom flange 24, both flanges projecting at opposite sides of the central web. The vertical height of the cross member is less than that of the main member, such that, with the bottom surfaces of the two members co-planar, the top of flange 22 is just below the bottom of the main part of flange 16, i.e. that part inside the lips 16*a*.

FIG. 1 shows certain cuts which are made on the side of the main member, and on the end portion of the cross member, to provide the joint construction of this invention. The cuts which need to be made are:

1. A notch 26 cut into the outer edge of the top flange 16 of the main member, this being sufficiently deep to penetrate through the lip 16*a*. This notch has a width "b" which is just slightly greater than the thickness of web 20 of the cross member.

2. In the cross member, two opposed slots 28 are cut in opposite sides of the flange 22, these being of sufficient width to accommodate the lip 16*a*, the slots being spaced from the end of the cross member by a dimension slightly smaller than "a". The slots are cut back close to the web of the cross member, to eventually allow the lips 16*a* at each side of the notch 26 to enter these slots. The rear surfaces 28*a* of the slots are sloped as shown in FIG. 3, to facilitate fitting of the parts together, as will be described.

3. The lower flange 24 of the cross member, and the lower part of its web 20 are cut back relative to the upper flange 22 and the upper part of the web, as shown in side view in FIG. 3. The result is to provide the web with a vertical end surface 20*a*, a bottom, horizontal surface 20*c*, and a sloping camming surface 20*b* joining these surfaces and being inclined at an angle of around 40° to the horizontal axis of the cross member. The arrangement is such that in the final position, as shown in FIG. 3, the cross member can rest with surface 20*c* supported by flange 18, with surface 20*a* abutting the web 14 of the main member, and with the slots 28 receiving the lips 16*a* of the main member. The lower flange 24 of the cross member is cut in such a way that it abuts the side of the main member when in the locked position.

In forming the cuts required for the joint, the notches 26 and slots 28 can be cut by diamond wheels, which is a simple and economical procedure which does not seriously weaken the glass fibre reinforced plastic pultrusions. The flange 24 and web 20 of the cross member can also easily be cut by diamond wheels. It may be noted that no drilling is required.

Figure 3:
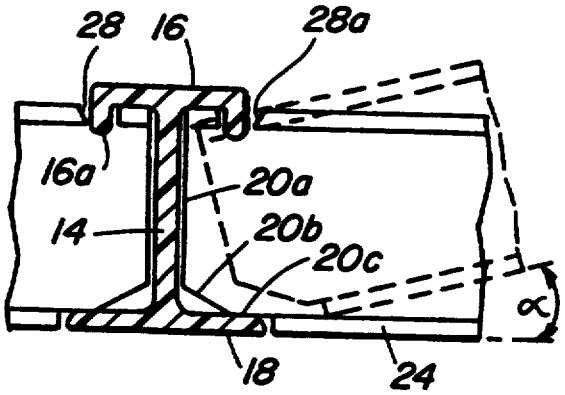
FIG. 3 is a sectional view on lines 3—3 of FIG. 2 showing positions of the cross member both in the assembled condition and in the position just prior to final positioning.

When it is desired to assembly the parts on site, a main member is first positioned, and cross members are inserted and locked in place by the tiling action indicated in FIG. 3. For this, the outer end of the cross member is raised so that the cross member at an angle $\alpha$ of about 15° to the horizontal. The upper end of flange 22 is inserted under flange 16 of the main member so that the lips 16*a* at each side of notch 26 enter slots 28, with web 20 fitting into the notch. The sloped rear surface 28*a* of the slots accommodates the lips 16*a* in the tilted position. The cross member is then tilted down to the final horizontal position, with the camming surface 20*b* acting against the upper corner of flange 18 and guiding the parts into the final position. Here, the cross member is held from dislocation by engagement of the lips in slots 28, and is prevented from moving laterally by engagement of the flange 20 in the lower part of notch 26 between the lips. After a series of cross members has been fitted in place, a further main member can be connected to the rear ends of these cross members by rotational tilting of the main member as necessary.

It will be apparent that some variations are possible without going beyond the scope of the invention. Thus, it would be possible to use a wider notch 26, with slots 28 of shallower depth, and with a part of the upper flange 22 held between the lips at the side of the notch.

Figure 4:
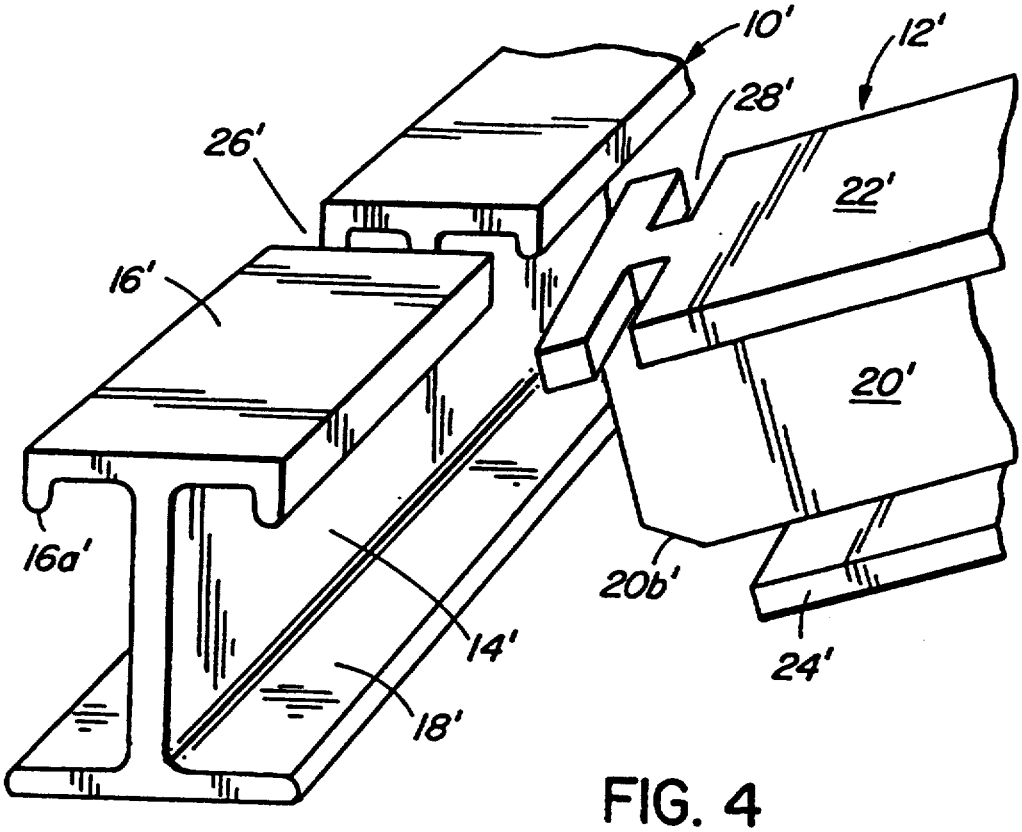
FIGS. 4 and 5 are assembly and final perspective views of an alternative construction.
Figure 5:
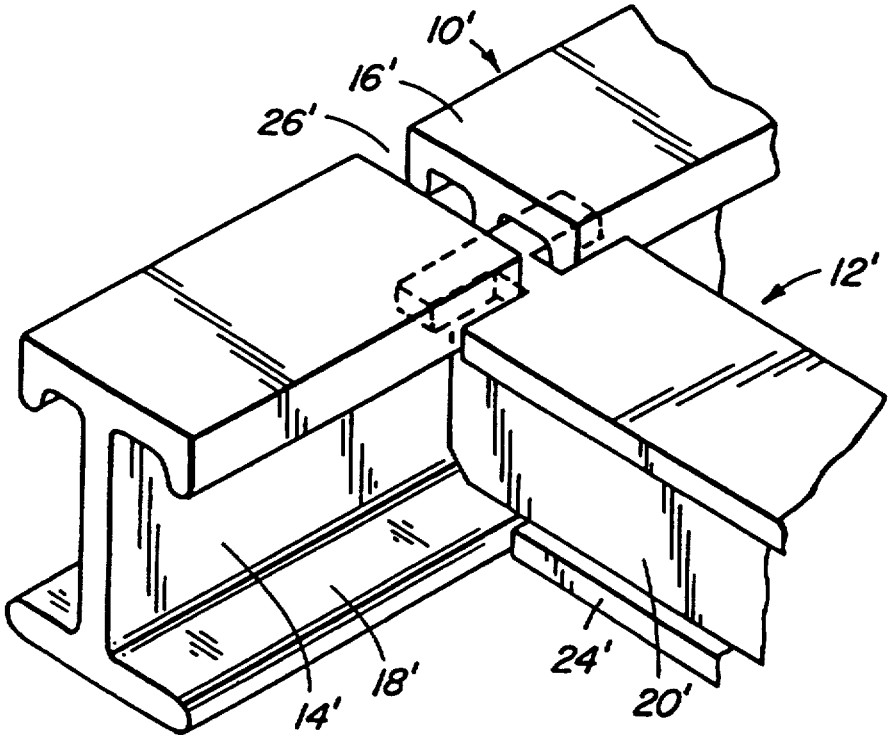

FIGS. 4 and 5 show perspective views of an alternative joint construction; elements corresponding to those of the first embodiment are shown by corresponding references with the prime added. The end formation of the cross member has slots 28' corresponding to slots 28 of the first embodiment. However, the main member 10' is formed with a single cut 26' which extends right across its top, being deep enough to form notches through the depending lips at both sides of flange 16'. This use of a single cut reduces the cutting operations needed for forming the joint.

I claim:

1. In a suspended ceiling system comprising:

a plurality of elongated main members each having a central web and top and bottom flanges projecting at opposite sides of the web, the top flange having depending lips spaced from each side of the web;

a plurality of elongated cross members each having a central web and top and bottom flanges projecting at opposite sides of the web;

an improved joint construction for connecting an end portion of a cross member to a side of a main member, including a notch in one said depending lip capable of receiving said central web of said end portion, and opposed slots in the top flange of said end portion capable of receiving portions of said depending lip on each side of said notch, the bottom flange and web of said end portion being configured to allow the lip to be interlocked with said slots by a relative tilting motion between the cross member and the main member, the end portion resting on the main member bottom flange when the parts are in their final position.

2. A joint construction according to claim 1, wherein the bottom flange of the end portion is set back relative to the top flange of the end portion, and wherein the dimensions of the parts are such that with the parts in their final position, a lower surface of the cross member web rests on bottom flange of the main member, and the lower surfaces of the flanges of all members are co-planar.

3. A joint construction according to claim 1, wherein both said main and cross members are formed as pultrusions of glass fibre reinforced plastic, and wherein the webs of said members are unapertured.

4. A joint construction according to claim 1, wherein said notch is formed as part of a single cut extending across the top of the main member and providing notches in both the depending lips of the top flange.

* * * * *